US005743120A

United States Patent [19]

Balliett

[11] Patent Number: 5,743,120

[45] Date of Patent: Apr. 28, 1998

[54] WIRE-DRAWING LUBRICANT AND METHOD OF USE

[75] Inventor: Robert W. Balliett, Westborough, Mass.

[73] Assignee: H.C. Starck, Inc., Newton, Mass.

[21] Appl. No.: 439,525

[22] Filed: May 12, 1995

[51] Int. Cl.[6] ..... B21B 45/02

[52] U.S. Cl. ..... 72/42

[58] Field of Search ..... 72/39, 41, 42, 72/46, 47; 252/58

[56] References Cited

U.S. PATENT DOCUMENTS

| | | | |
|---|---|---|---|
| 3,316,312 | 4/1967 | McCane et al. | 252/58 |
| 4,148,204 | 4/1979 | Dotzer et al. | 72/47 |
| 4,464,922 | 8/1984 | Pamplin et al. | 72/41 |
| 4,724,093 | 2/1988 | Gambaretto | 252/58 |
| 4,857,215 | 8/1989 | Wong | 252/58 |

*Primary Examiner*—Lowell A. Larson
*Assistant Examiner*—Rodney A. Butler
*Attorney, Agent, or Firm*—Jerry Cohen

[57] ABSTRACT

A process for drawing wire employing a lubricant composed of perfluorocarbon compounds having the general formula $C_nF_{2n+2}$. Such fully fluorinated carbon compounds exhibit a very high degree of thermal and chemical stability, due to the strength of the carbon-fluorine bond. Further, because the compounds are fully fluorinated, and therefore do not contain chlorine and bromine, they have zero ozone depletion potential (ODP). Further, because the PFCs are photochemically non-reactive in the atmosphere, they are not precursors to photochemical smog and are exempt from the federal volatile organic compound (VOC) definition.

5 Claims, 21 Drawing Sheets

WIRE-DRAWING LUBRICANT AND METHOD OF USE

FIELD OF THE INVENTION

The present application relates to a process for drawing refractory and reactive metal wire, and more particularly tantalum fine wire.

BACKGROUND OF THE INVENTION

Wire drawing is one of the most difficult of the metal-forming operations. Wire is produced by reducing the cross-section of metal rod through a series of reduction dies until the desired final geometry is obtained. Wire has been produced from all of the common metals, including steel, copper, aluminum, gold, silver, etc., as well as from the refractory and reactive metals, including tantalum, niobium, molybdenum, tungsten, titanium, zirconium, etc. Because of the severe sliding contact between the wire and the die, lubricants are used in all wire drawing operations to reduce friction between the die and the wire, to flush the die to prevent the buildup of fines and dirt on the die surface, to reduce wear and galling between the die and the wire, to remove heat generated during plastic deformation, and to protect the surface characteristics of the finished wire.

The lubricants used today to draw the common metals are a complex blend of various esters, soaps, and other extreme-pressure lubricants. Oil- or polyglycol-based lubricants are often used in the form of emulsions in water at concentrations on the order of 10%, sometimes with additives to give the emulsions the necessary detergency to keep both the dies and wire clean. Ease of cleaning is a fundamental parameter in the selection of wire-drawing lubricants. In the state-of-the-art, these classes of lubricants have been found to be inadequate in the production of refractory and reactive metal wire.

Various chlorinated oils have been used over phosphate precoats, as well as mixtures of various graphite and molybdenum disulfide lubricants, with limited success to draw refractory and reactive metal wire. More recently, chlorotrifluoroethylene (CTFE)-based oils have become the lubricant of choice in the production of refractory and reactive metal wire, generally in a viscosity range of 20 to 150 centistokes. While CTFE lubricants are now used almost exclusively in the production of electronic-grade tantalum wire, they present a number of serious operating limitations. Because of the poor heat transfer characteristics of the CTFE lubricants, drawing speeds must be very slow, generally in the range of 100 to 300 FPM. Typical wire-drawing speeds for the common metals are in the range of 5000 to 20,000 FPM. As a result, drawing costs for refractory and reactive metals are very high by comparison. In addition, the CTFE lubricants are only marginally effective in reducing wear and galling between the wire and the die and in flushing the wear products away from the die entrance. These problems are very evident in the short die life (<20 pounds per set) obtained when using carbide dies to draw tantalum wire and in continuing problems with surface roughness and dimensional control (including both diameter and roundness). All of these limitations associated with CTFE lubricants make refractory and reactive metal wire drawing an inherently high-cost process that results in a marginal quality product.

A more serious limitation of the CTFE lubricants is found when attempting to remove them from the surface of the finished wire. The removal of these lubricants is typically accomplished using solvents, typically 1,1,1-trichloroethane. With the increasing restrictions placed on solvent use because of flammability, toxicology, ozone depletion, and global warming, it is almost completely impossible to remove the CTFE lubricants from wire products. A number of hot, aqueous degreasing systems, with and without ultrasonics, have been used to attempt to remove these lubricants with limited success. As a result, CTFE lubricant residues on electronic-grade wire surfaces continue to be a cause of component failure.

Accordingly, it is the object of this invention to provide an improved process of drawing refractory and reactive metal wire, avoiding the foregoing problems.

A further object of the invention is to use in a conventional wire-drawing process a nonflammable and nontoxic lubricant.

It is another object of the invention to use in a conventional wire-drawing process a lubricant having zero ozone depletion potential (ODP).

It is a still further object of the invention to use in a conventional wire-drawing process a lubricant that is photochemically nonreactive in the atmosphere, is not a precursor to photochemical smog, and is exempt from the United States Environmental Protection Agency's volatile organic compound (VOC) definition.

SUMMARY OF THE INVENTION

The foregoing objects are achieved in a process for drawing wire using a conventional wire-drawing machine, including the use of perfluorocarbon fluids as lubricants while drawing refractory and reactive metal wire through the dies.

Perfluorocarbon fluids originally were developed for use as heat-transfer fluids. They are currently used in heat-transfer, refilteration, and cleaning applications. The present process employs a lubricant composed of perfluorocarbon compounds (PFCs) selected from noncyclic perfluoroalkanes having the general formula $C_nF_{2n+2}$ and perfluoroamines, either alone or in combination. Such fully fluorinated carbon compounds exhibit a very high degree of thermal and chemical stability due to the strength of the carbon-fluorine bond. PFCs are also characterized by extremely low surface tension, low viscosity, and high fluid density. They are clear, odorless, colorless fluids with boiling points from approximately 30° C. to approximately 300° C.

Importantly, because PFCs are fully fluorinated, and therefore do not contain chlorine or bromine, they have zero ozone depletion potential (ODP). They are nonflammable and nontoxic Further, because the PFCs are photochemically nonreactive in the atmosphere, they are not precursors to photochemical smog and are exempt from the federal volatile organic compound (VOC) definition. In addition, they cost significantly less than the chlorotrifluoroethylene oils currently in use. Accordingly, PFCs are now found to be the preferred lubricants in high-speed fine wire drawing of refractory and reactive metals.

In the wire drawing process, the perfluorocarbon fluids of the present invention have greatly extended the ranges of the major wire drawing variable available to the process engineer. While using the CTFE lubricants, the reduction per die was limited to approximately 15%. The use of PFC lubricants allows reductions as large as 26% per die. This will allow the next generation of wire drawing equipment to be much more productive. In addition, operating speeds can be increased by more than 10 fold, greatly reducing the number of wire drawing machines required at a given production level. The CTFE lubricants were limited to approximately 200 FPM while the PFC lubricants have been used at speeds of over 2,000 FPM with no signs of having reached an upper limit. In addition, die wear is minimized to the point that wire can be drawn without annealing from 0.103" (2.5 mm) to a final diameter of 0.005" (0.127 mm).

All grades of the perfluorocarbon fluids evaluated to date have been used to produce high-quality tantalum wire. PFC fluids ranging from perfluoroalkanes, such as 3M's PF-5050 (perfluoropentane ($C_5F_{12}$)) having a boiling point of only 30° C. and a viscosity of 0.4 centistokes, to perfluoroamines, such as 3M's FC-70 (a blend of perfluorotripropylamine ($C_3NF_9$) and perfluorotributylamine ($C_4NF_{11}$)) ($C_{15}F_{33}N$) having a boiling point of 215° C. and a viscosity of 14 centistokes have all been used to produce high quality wire at high drawing speeds. 3M Company's FC-40 has been extensively evaluated because of its combination of low price and high boiling point (155° C.). This fluid has a viscosity of only 2 centistokes and a vapor pressure at room temperature of 3 torr. All of the data suggest that there are many other PFC fluids that are good metalworking lubricants.

The fact that lubricating characteristics are not dependent upon PFC fluid viscosity is unique to this class of fluids and is not yet understood in terms of current metalworking lubrication theory. In fact, the use of a wire-drawing lubricant having a viscosity of less than 1 centistoke is contrary to most lubrication theories.

A variety of metal wire-drawing tasks can be enhanced through the above process. But particular benefits are realized in the context making fine tantalum wire to be used as anode lead wires in tantalum electrolytic capacitors. The tantalum wire (typically 5 mils to 20 mils (0.127 mm to 0.508 mm in diameter) is buttwelded to a porous, sintered powder anode, or is embedded therein prior to sintering and bonded thereto in sintering. Minimizing leakage of the capacitor using such an anode depends in part on the cleanliness of the lead wire, which is directly affected by lubricant selection.

Significant reduction in wire DC leakage has been achieved with wires produced in accordance with the present invention. The leakage current is directly related to the surface topography of the wire, as well as the amount of lubricant that remains trapped in the cracks and crevices on the surface of the wire. DC leakage currents can be reduced by producing a smoother wire surface and eliminating residual lubricant from the wire surface. The DC leakage is measured by anodizing a length of wire to completely cover the surface with a tantalum oxide dielectric film. This anodized wire is placed in on electrolyte and a DC voltage is applied to the tantalum lead itself. The DC current "leaking" through the dielectric film is measured at a fixed voltage. This leakage current is a measure of the integrity of the dielectric film. The dielectric film integrity itself is a measure of the overall surface roughness and cleanliness of the wire surface. By producing a smooth surface free from residual lubricants, improved dielectric films are produced, thus improving the DC leakage characteristics of the wire.

DETAILED DESCRIPTION OF PREFERRED EMBODIMENTS

Figure 1A:
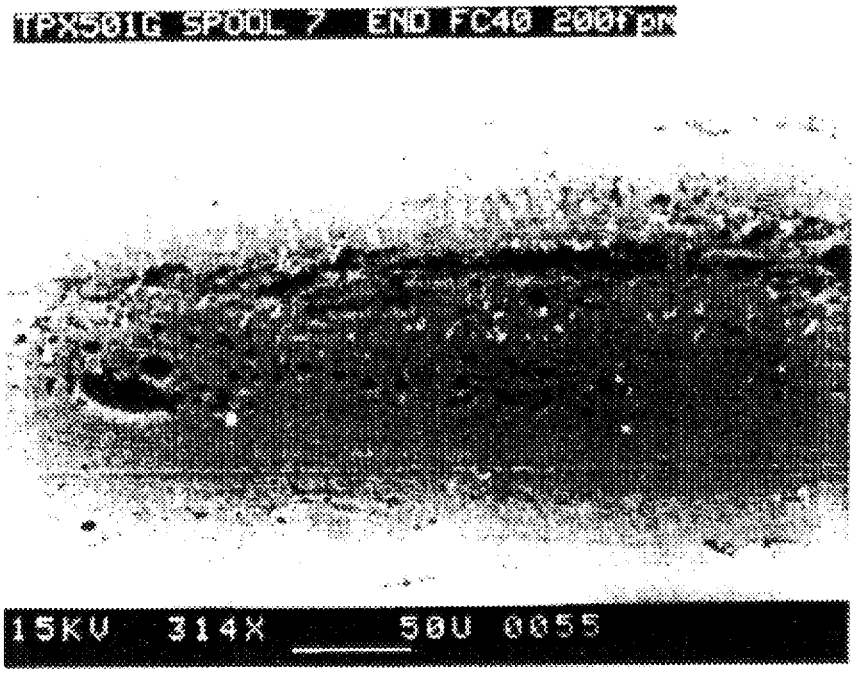
FIG. 1 shows scanning electron micrographs at 300X and 1000X of the surface of wire drawn using FC-40 perfluorocarbon fluid at 200 ft/min (61 m/min).

The practice of the invention according to preferred embodiments thereof is indicated by the following non-limiting examples:

EXAMPLE 1

169.5 lbs (77.1 kg) of 0.0098" (0.0249 cm) half-hard temper tantalum wire was drawn through a Heinrich wire-drawing machine (MODEL # 21W21) using FC-40 perfluorocarbon fluid (3M Company) as the lubricant. Wire speed ranged from 200 ft/min (61 m/min) to 1386 ft/min (424.5 m/min). The average roundness measured using a laser micrometer at the beginning of each of the coils of wire was 16 millionths of an inch (40.6 μm) with the average roundness at the end of each coil averaging 18 millionths of an inch (45.7 μm). An average of 42.4 lbs of wire was produced per set of dies.

EXAMPLE 2

70.2 lbs (31.9 kg) of 0.0079" (0.0201 cm) extra-hard temper tantalum wire was drawn through a Heinrich wire-drawing machine, as in Example 1, using 3M's FC40 perfluorocarbon fluid as the lubricant. Wire speed ranged from 500 ft/min (152.4 m/min) to 1000 ft/min (304.8 m/min). The average roundness at the beginning of each of the coils of wire was 11 millionths of an inch (27.9 μm) with the average roundness at the end of each coil averaging 11 millionths of an inch (27.3 μm). An average of 35.1 lbs of wire was produced per set of dies.

EXAMPLE 3

231.8 lbs. (105.4 kg) of 00079" (0.0201 cm) hard temper tantalum wire was drawn through a Heinrich wire-drawing machine, as in Example 1, using 3M's PC-40 perfluorocarbon fluid as the lubricant. Wire speed ranged from 800 ft/min (243.8 m/min) to 1480 ft/min (451.1 m/min). The average roundness at the beginning of each of the coils of wire was 12 millionths of an inch (30.5 μm) with the average roundness at the end of each coil averaging 16 millionths of an inch (40.6 μm). An average of 46.4 lbs of wire was produced per set of dies.

EXAMPLE 4

49.4 lbs (22.5 kg) of 0.0075" (0.0191 cm) hard temper tantalum wire was drawn through a Heinrich wire-drawing machine, as in Example 1, using 3M's FC-40 perfluorocarbon fluid as the lubricant. Wire speed ranged from 1480 ft/min (451.1 m/min) to 1600 ft/min (487.7 m/min). The average roundness at the beginning of each of the coils of wire was 15 millionths of an inch (38.1 μm) with the average roundness at the end of each coil averaging 17 millionths of an inch (43.2 μm). An average of 24.7 lbs of wire was produced per set of dies.

EXAMPLE 5

71.6 lbs (32.6 kg) of 0.091" (0.0231 cm) annealed temper tantalum wire was drawn through a Heinrich wire-drawing machine, as in Example 1, using 3M'6 FC-40 perfluorocarbon fluid as the lubricant. Wire speed was 1200 ft/min (365.8 m/min). The average roundness at the beginning and the end of each of the coils of wire was 20 millionths of an inch (50.8 μm). An average of 71.6 lbs of wire was produced per set of dies.

EXAMPLE 6

In addition to the normal dimensional, visual, and mechanical property evaluation performed on the wire as it is produced, the wire drawn using the perfluorocarbon lubricants was evaluated using scanning electron microscopy (SEM).

Figure 1B:
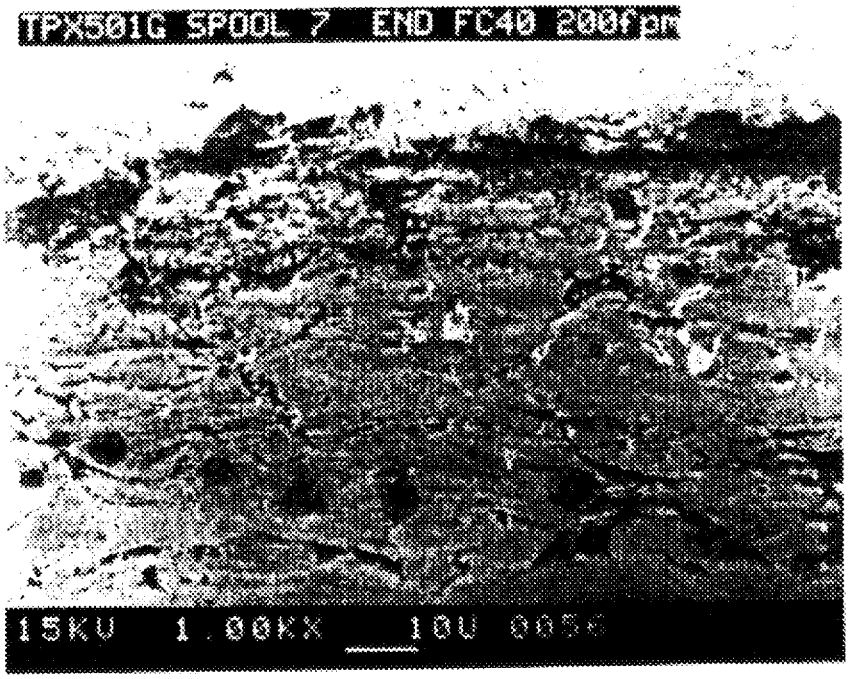
Figure 2A:
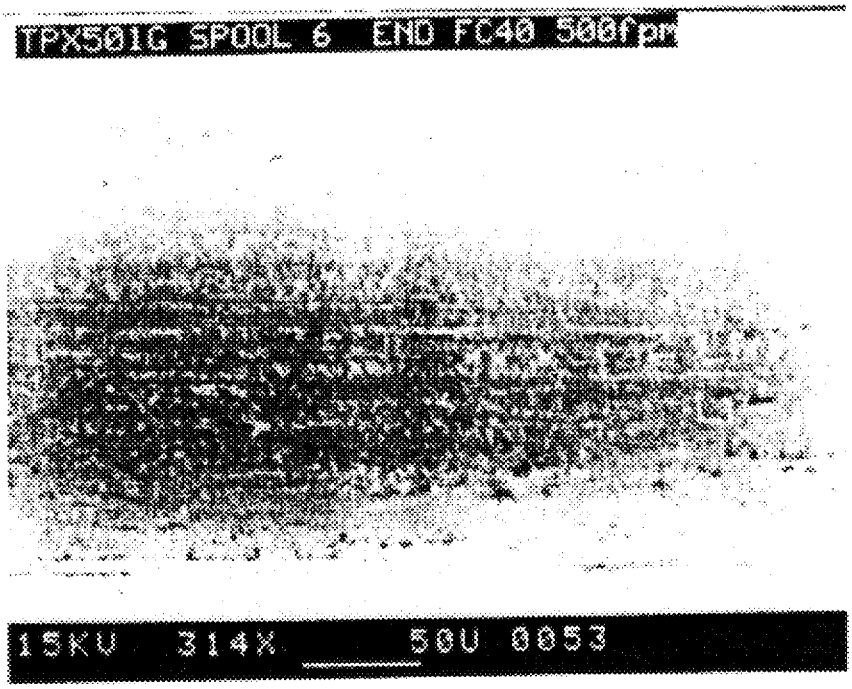
FIG. 2 shows scanning electron micrographs at 300X and 1000X of the surface of wire drawn using FC-40 PFC fluid at 500 ft/min (152.4 m/min).
Figure 2B:
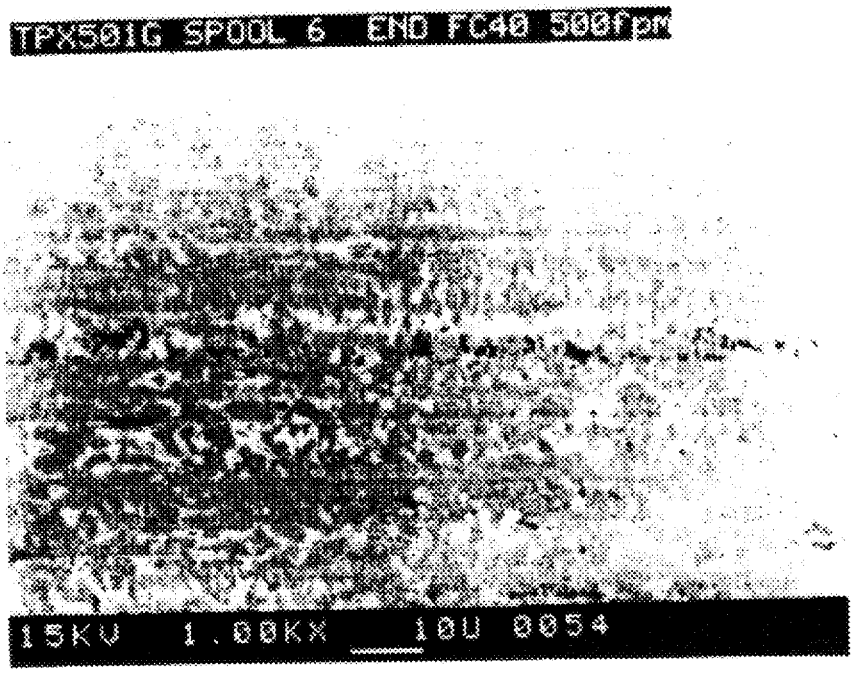
Figure 3A:
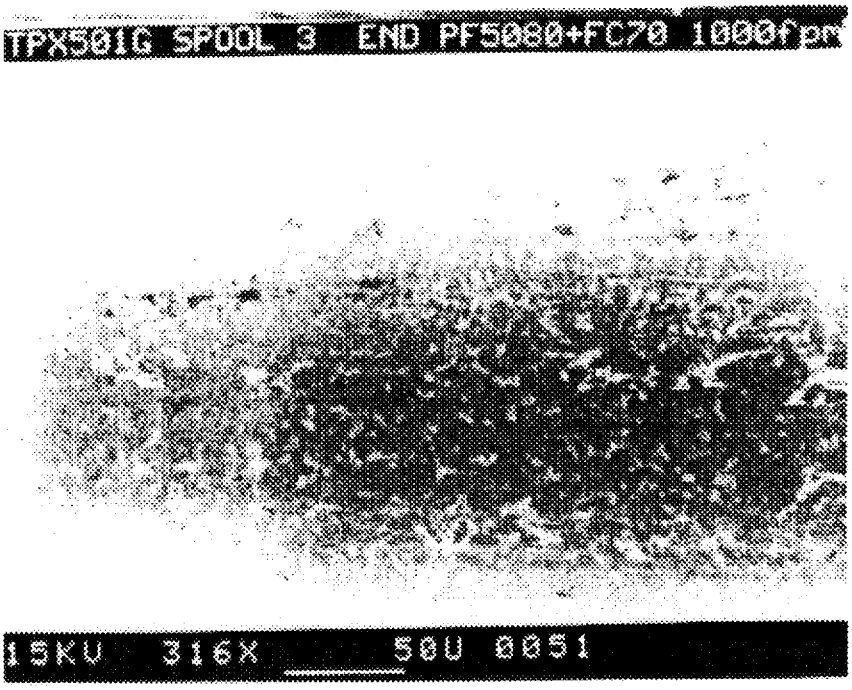
FIG. 3 shows scanning electron micrographs at 300X and 1000X of the surface of wire drawn using FC-40 PFC fluid at 1,000 ft/min (304.8 m/min).
Figure 3B:
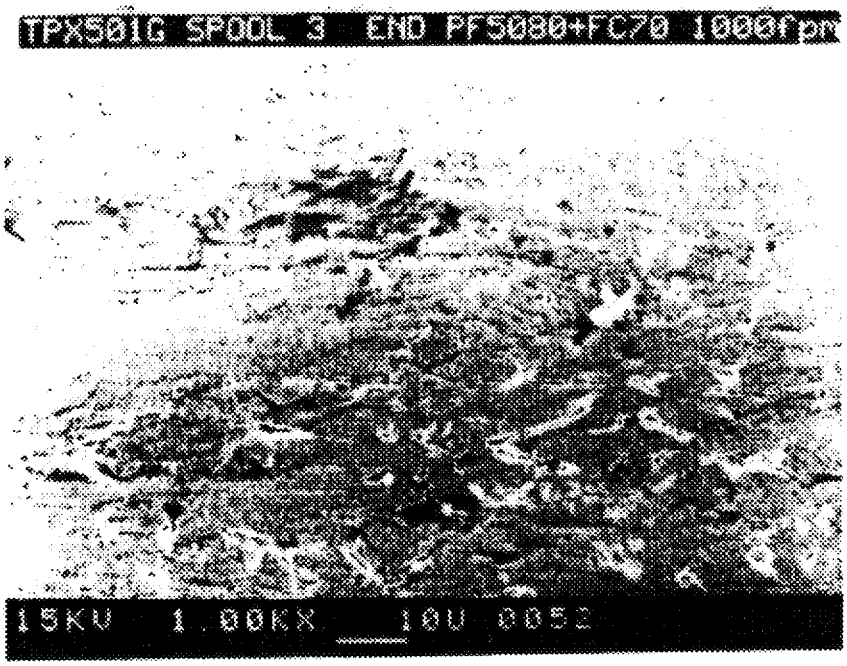

Scanning electron micrographs taken at 300X and 1000X of capacitor-grade tantalum wire drawn using FC-40 at 200 ft/min (61 m/min), 500 ft/min (152.4 m/min), and 1000 ft/min (304.8 m/min) are shown in FIGS. 1–3, respectively. The 300X pictures show that wire surface quality actually improves with increasing drawing speed. Overall, the frequency and depths of the cracks and crevices on the surface of the wire drawn using perfluorocarbon fluid lubricant diminish with increasing wire-drawing speed.

EXAMPLE 7

Figure 4A:
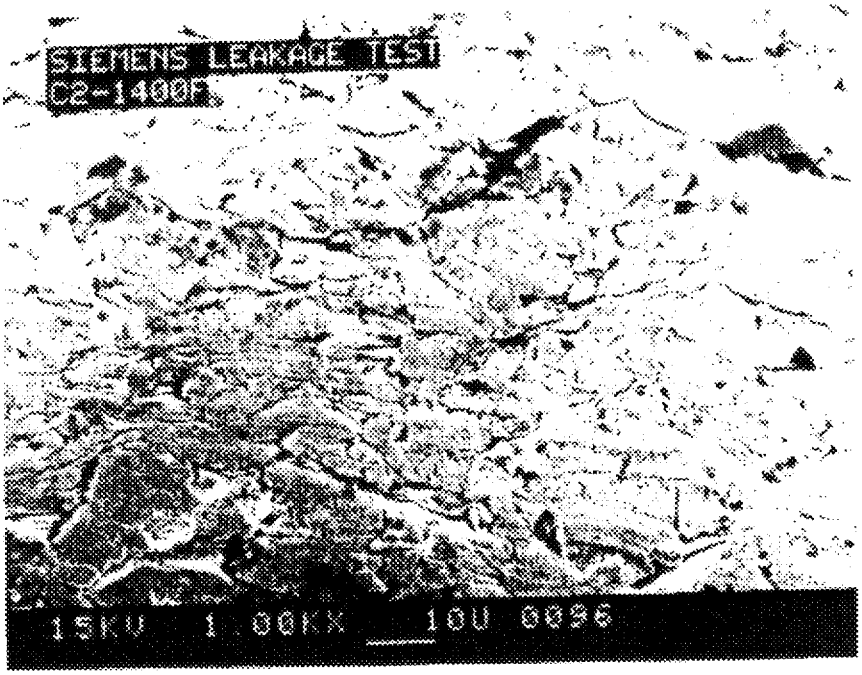
FIG. 4 shows scanning electron micrographs at 1000X of the surface of two wire samples drawn using CTFE lubricant at 200 ft/min (61 m/min).
Figure 4B:
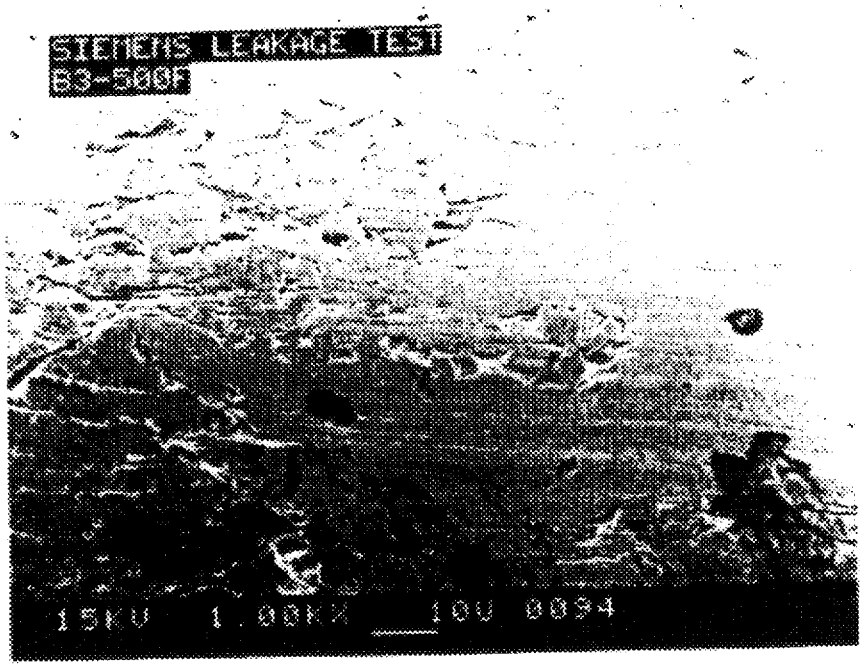
Figure 5:
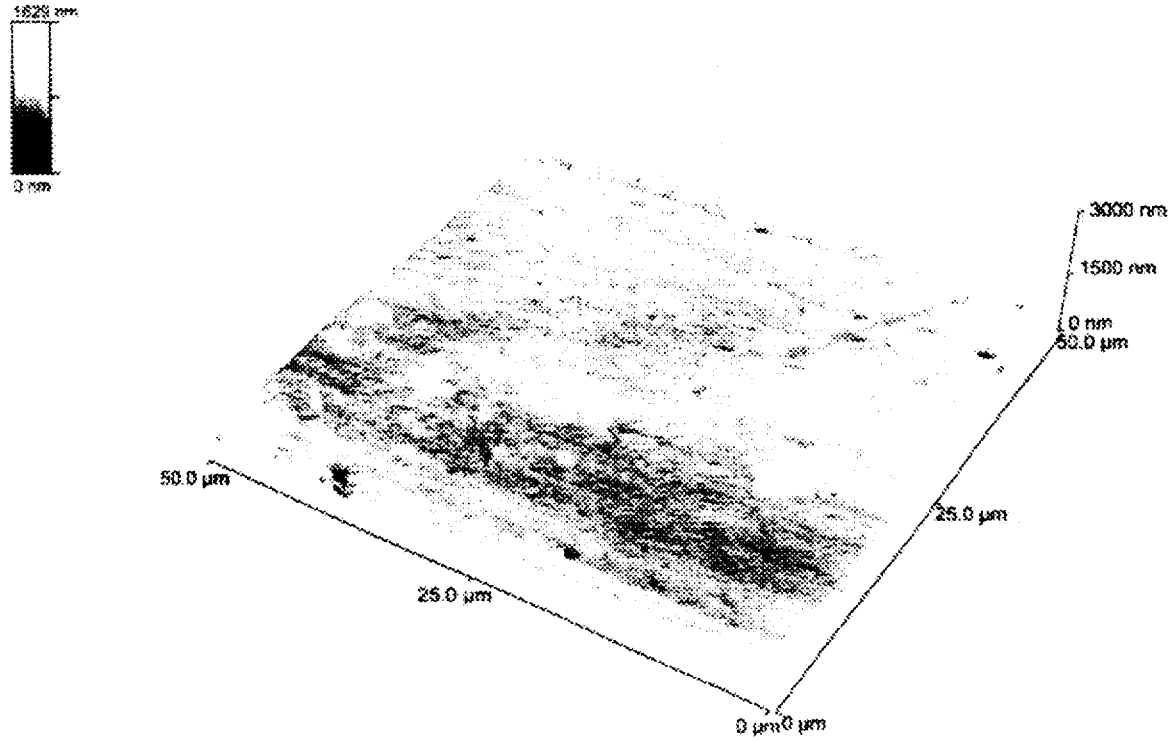
FIG. 5 shows an SPM micrograph at 2500X of a 50$\mu^2$ area of the surface of TPX wire drawn with CTFE lubricant.
Figure 6:
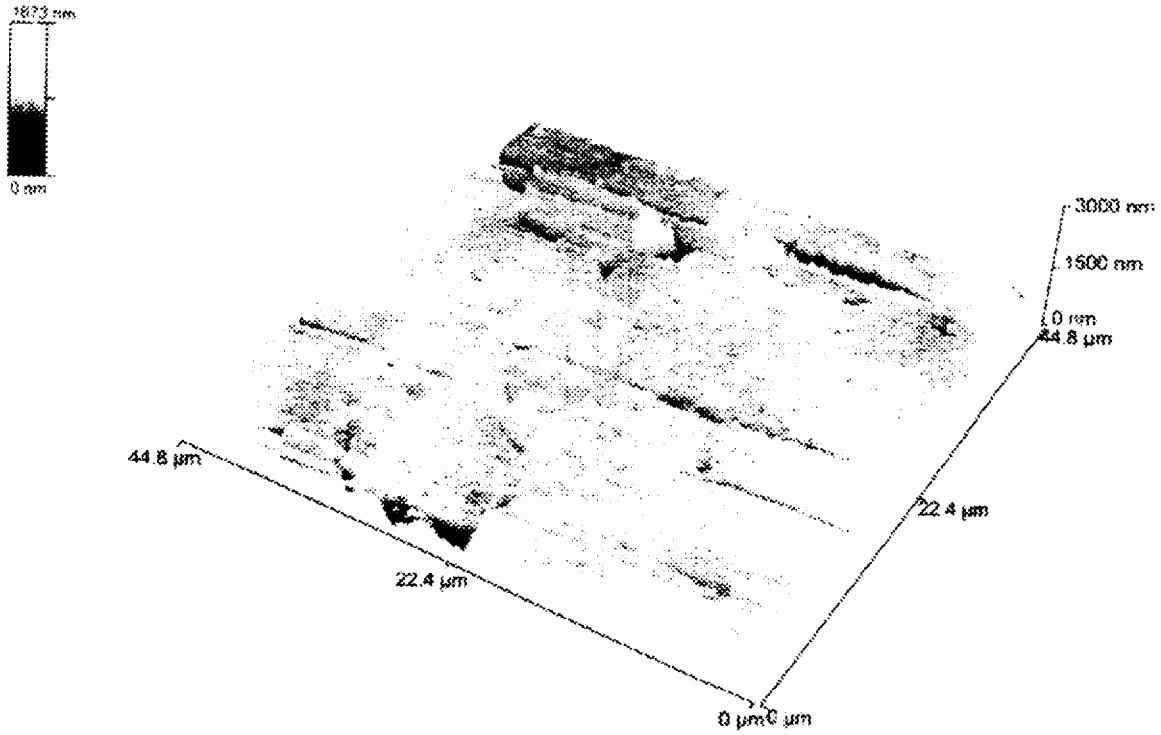
FIG. 6 shows an SPM micrograph at 2500X of a 50$\mu^2$ area of the surface of TPX wire drawn with FC-40 PFC fluid.
Figure 7:
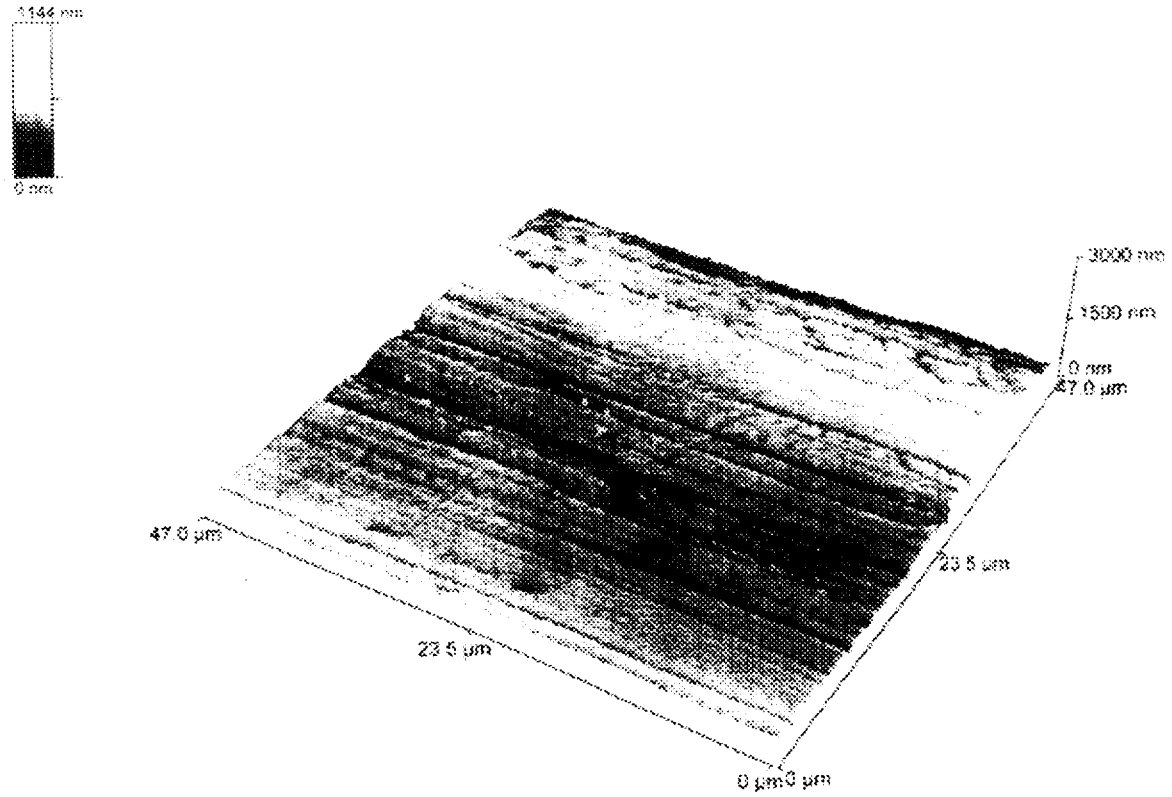
FIG. 7 shows an SPM micrograph at 2500X of a 50$\mu^2$ area of the surface of Cabot's DR12 wire drawn with CTFE lubricant.

The surface of a capacitor grade tantalum wire drawn using a CTFE lubricant at 200 ft/min (61 m/min) is shown in FIG. 4 at 1000X. This picture shows the typical structure seen on wire drawn using a conventional chlorotrifluoroethylene lubricant. As can be seen, this wire shows a great deal of surface damage, particularly in the form of relatively thin platelets of material torn from the surface of the wire. This appears to be the mechanism by which most of the "fines" observed in the fine wire-drawing process are generated. The fact that fines are not observed in wire drawn using the perfluorocarbon fluid lubricant indicates that surface damage due to this flaking caused by galling and seizing (as a result of lubricant breakdown) has been eliminated.

EXAMPLE 8

Figure 8:
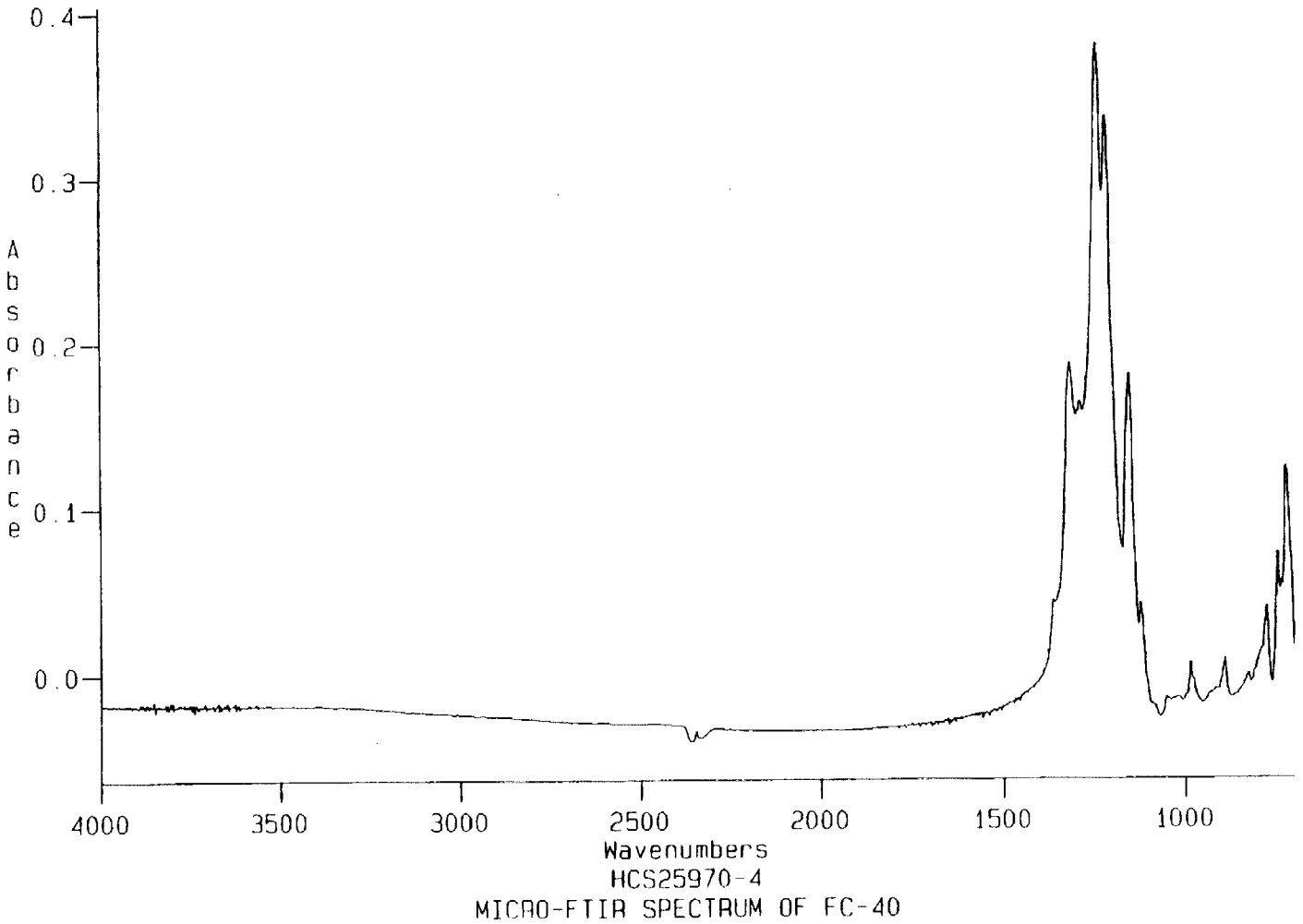
FIG. 8 shows the reference micro-FTIR spectrum of the 3M FC-40 PFC fluid.
Figure 9:
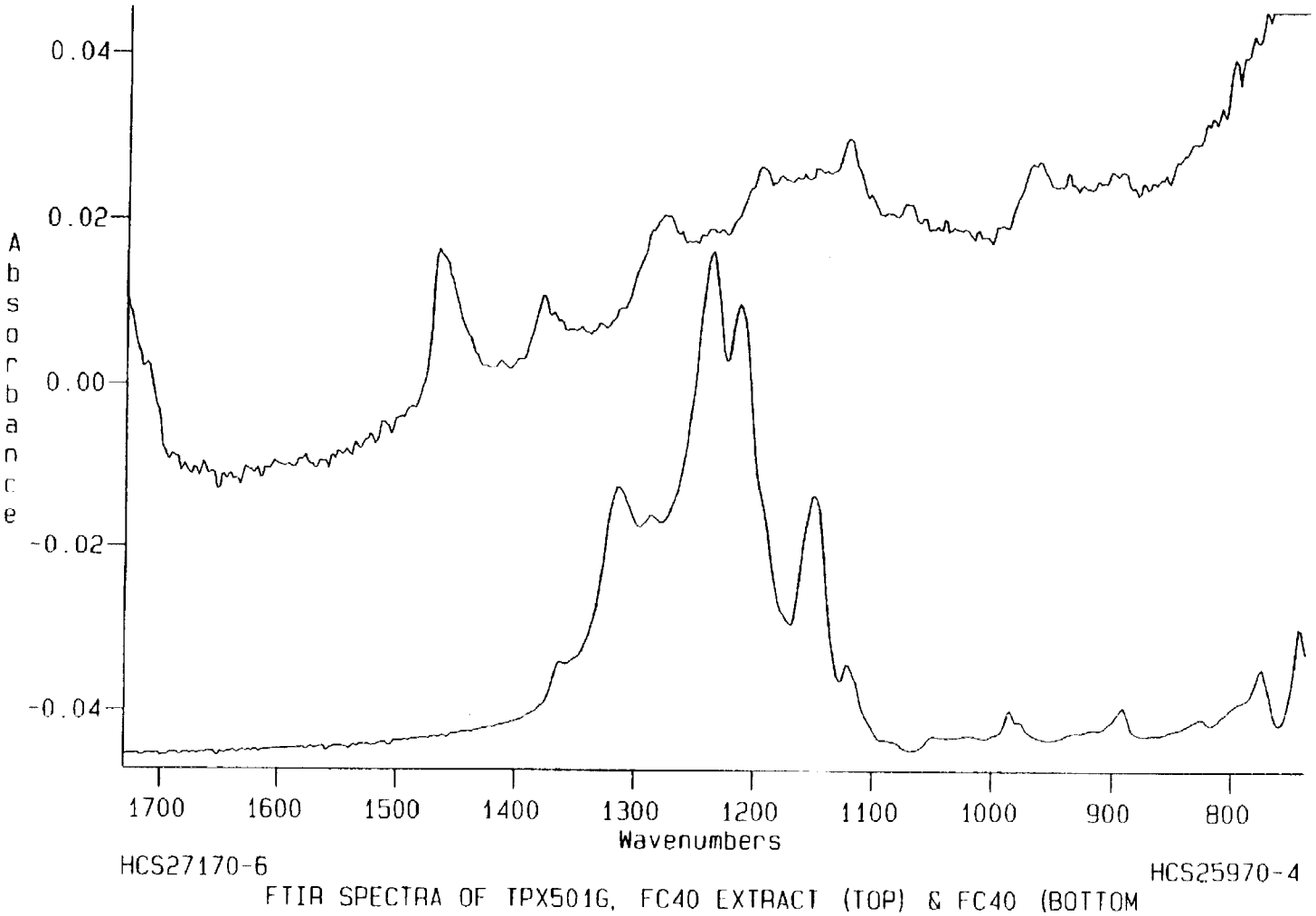
FIG. 9 shows the micro-FTIR spectrum of the extract from a sample of capacitor-grade tantalum wire together with the reference spectrum of the FC-40 PFC fluid.
Figure 10:
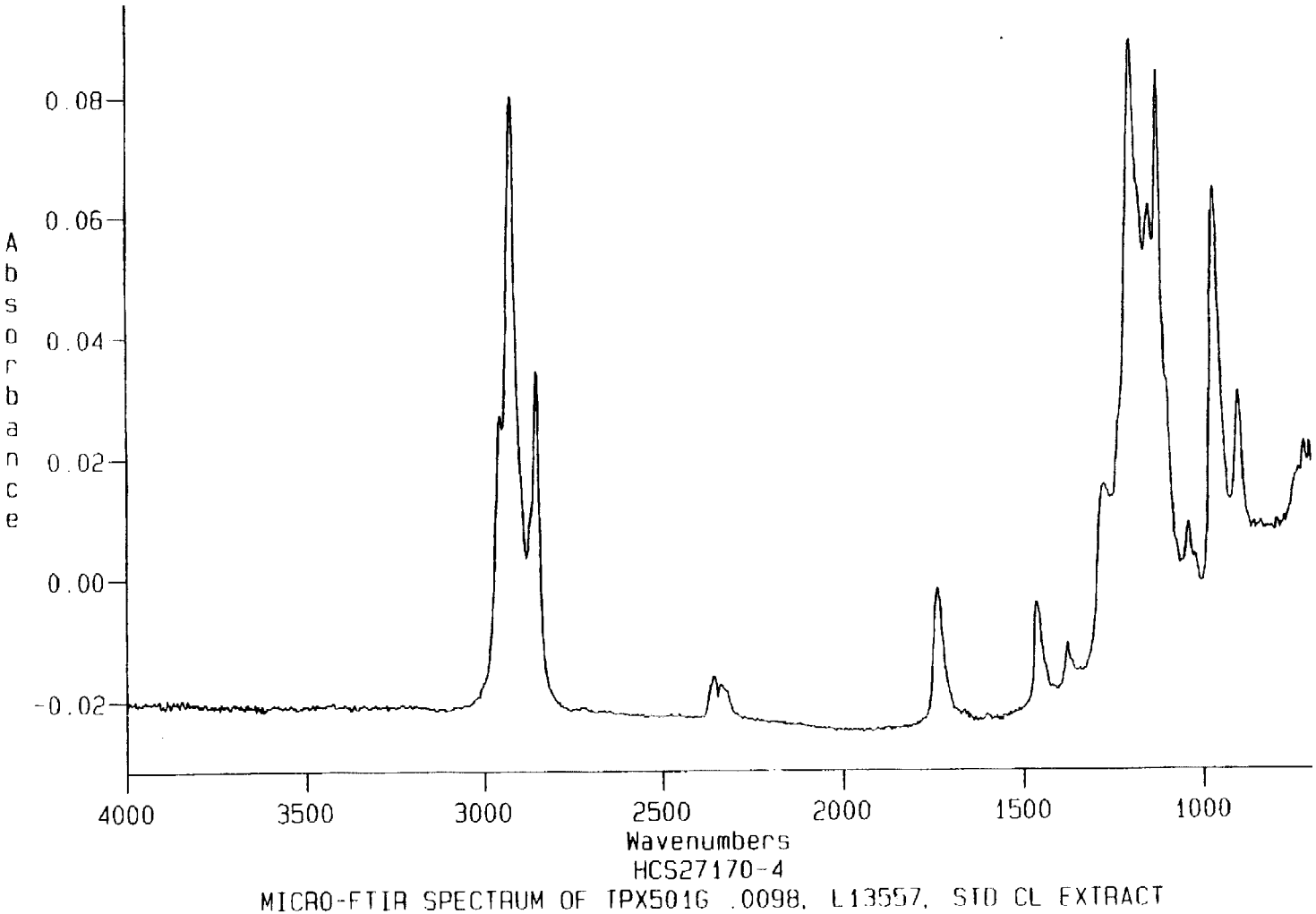
FIG. 10 shows the micro-FTIR spectrum of the extract removed from a sample of capacitor-grade tantalum wire after cleaning in an ultrasonic strand cleaning system used to draw capacitor-grade tantalum wire on a production basis.

In order to evaluate the overall degree of cleanliness of the as-drawn wire produced using a perfluorocarbon lubricant, samples were submitted to micro-FTIR infrared analysis. The reference spectrum of the 3M FC-40 lubricant is shown in FIG. 8. The spectrum of the methylene chloride extract from a sample of TPX 501G wire drawn using the perfluorocarbon lubricant, together with the reference spectrum of the FC-40, are shown in FIG. 9. It is important to note that essentially no lubricant residue of any kind is found on the wire, and that whatever residue that is present is definitely not FC-40. The overall absorbence values can be compared to the data shown in FIG. 10, which shows the FTIR spectrum of the extract removed from a sample of TPX 501G after cleaning in an ultrasonic strand cleaning system used to remove CTFE lubricants. Total absorbence values on the order of 0.1 absorbence units are typical of wire cleaned in the unit. In general, these absorbency values represent less than one monolayer of residual lubricant on the surface of the wire. The perfluorocarbon wire as drawn has less than 20% of this amount of surface contamination and is truly an electronically clean material.

Figure 11:
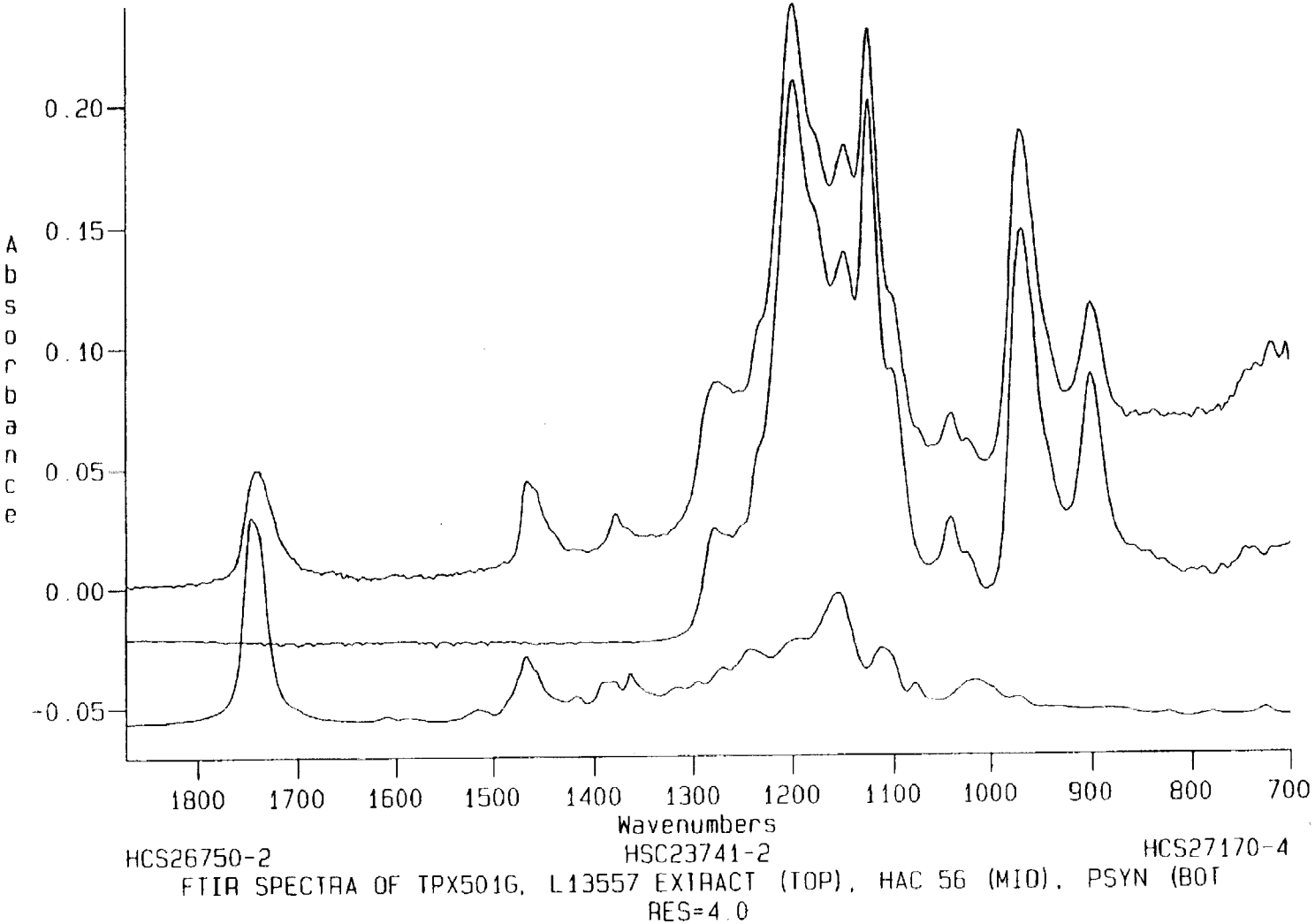
FIG. 11 shows the as-cleaned micro-FTIR spectrum superimposed on the reference spectra of a CTFE oil and an ester-based rod-rolling oil.

FIG. 11 shows the as-cleaned spectrum superimposed on the reference spectra of CTFE oil and an ester-based rod-rolling oil used in earlier stages of the wire production process. These two materials account for essentially 100% of the residue found on the surface of our uncleaned capacitor-grade wire. No indication of any residual FC-40 was found. As a result of this analysis, it appears that wire drawn using the perfluorocarbon lubricant can be used as drawn. Subsequent ultrasonic cleaning will only serve to contaminate the surface of the wire.

EXAMPLE 10

Figure 12:
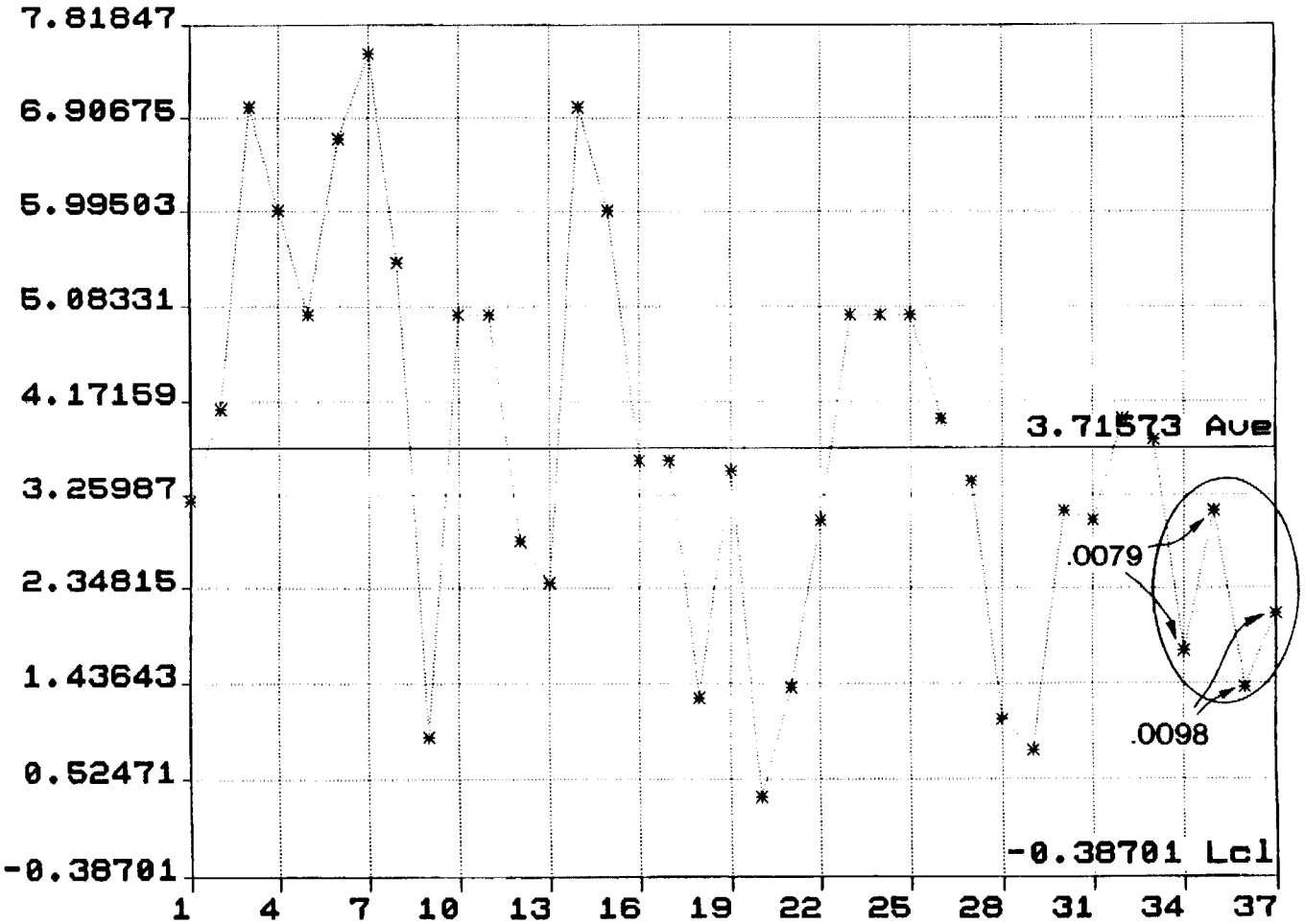
FIG. 12 shows as-received leakage $\mu A/cm^2$ of TPX wire as drawn with FC-40 PFC fluid.
Figure 13:
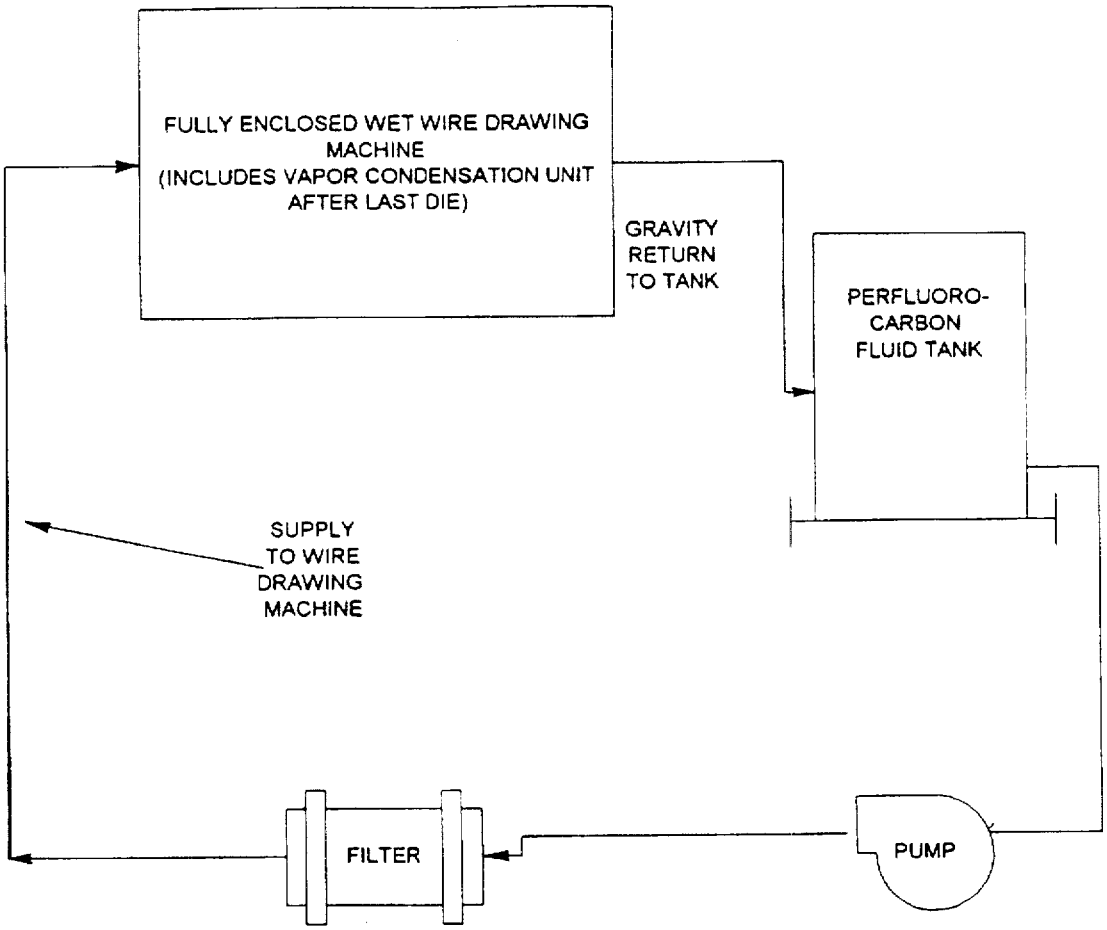
Figure 14A:
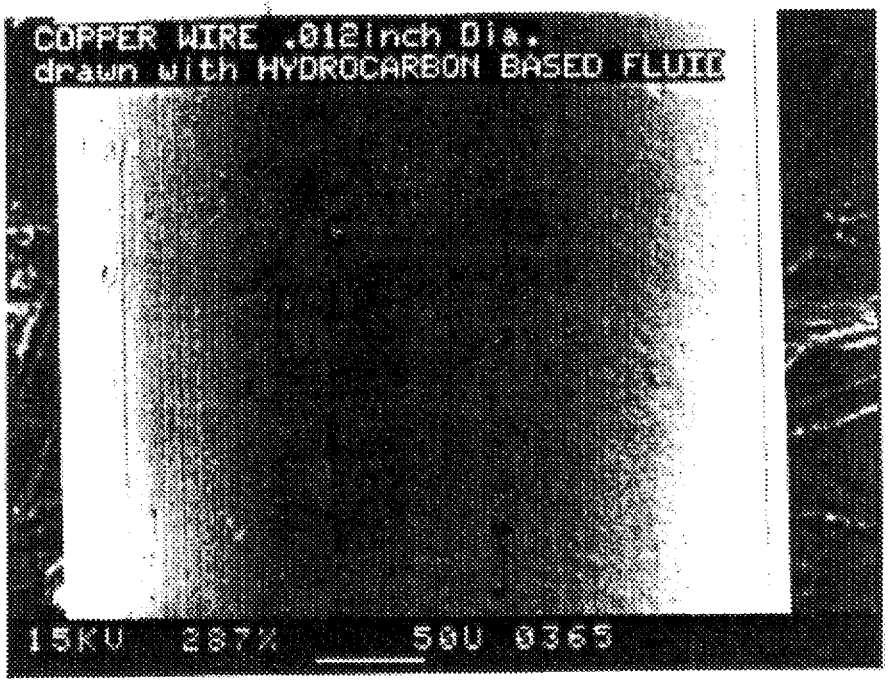
Figure 14B:
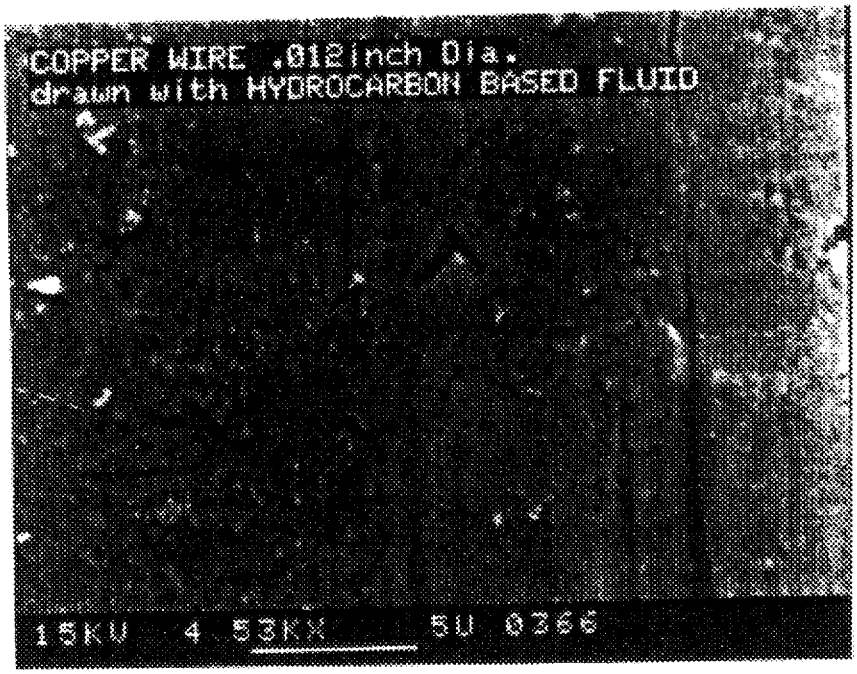
Figure 14C:
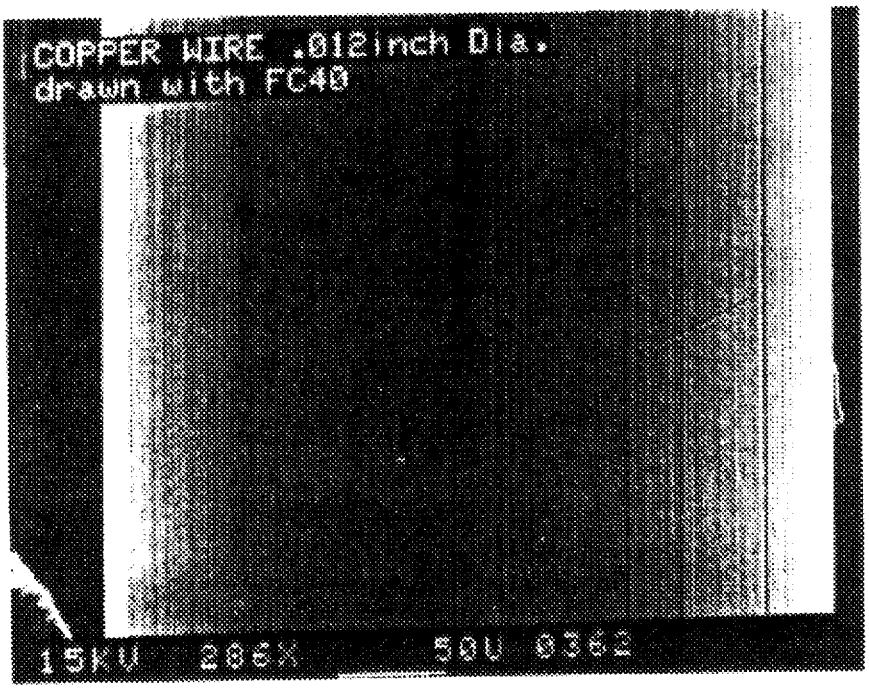
Figure 14D:
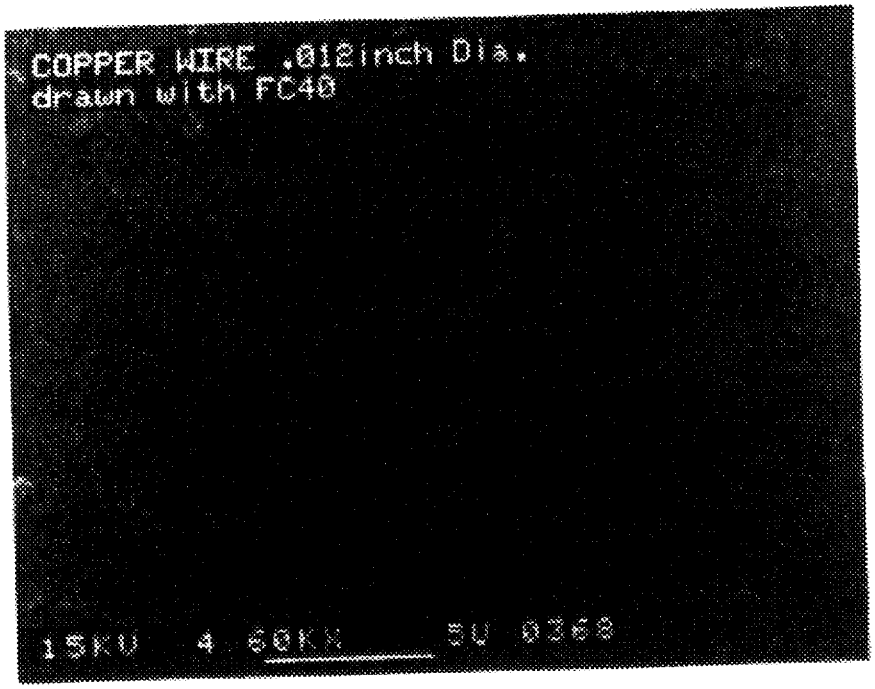
Figure 15A:
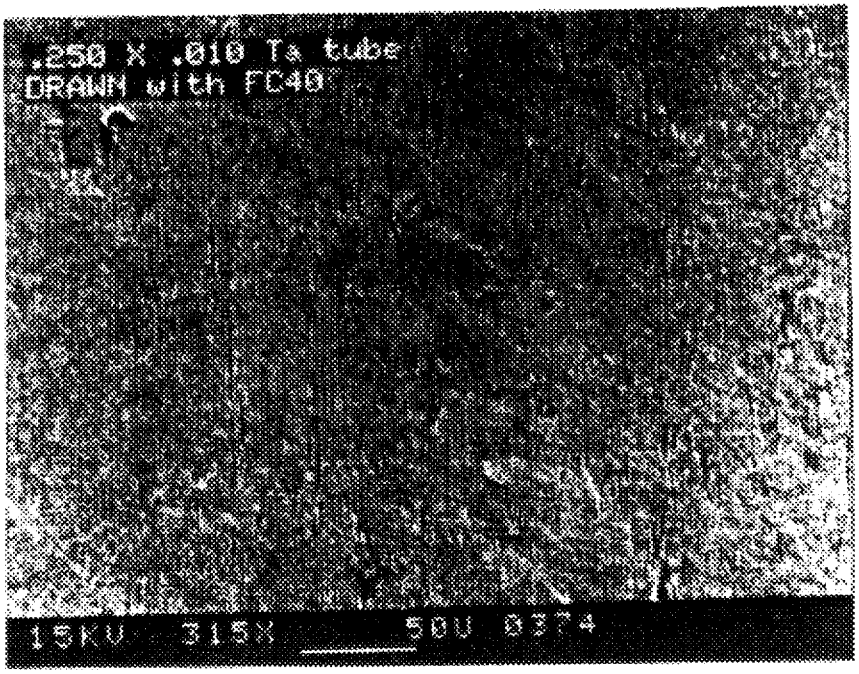
Figure 15B:
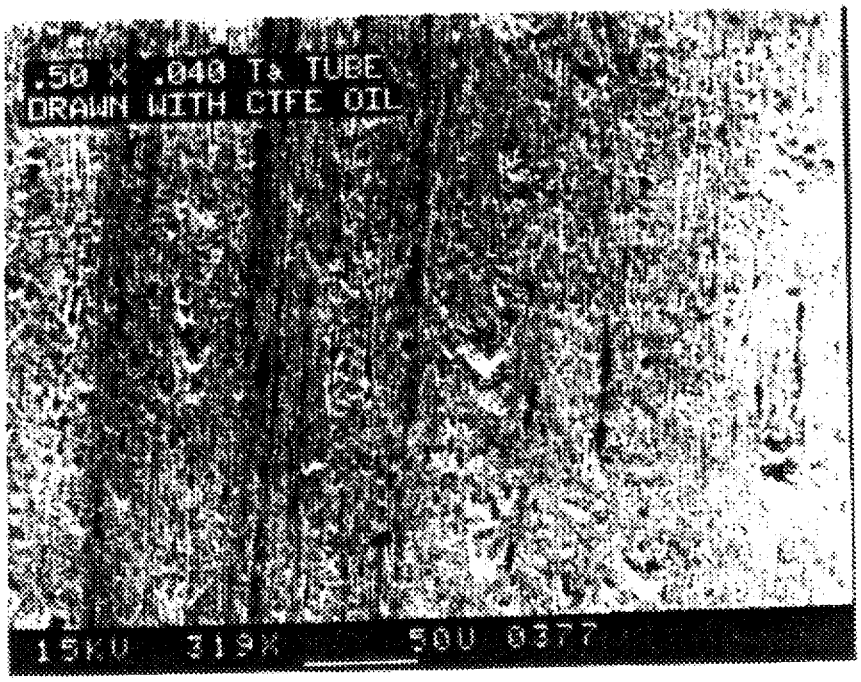
Figure 16A:
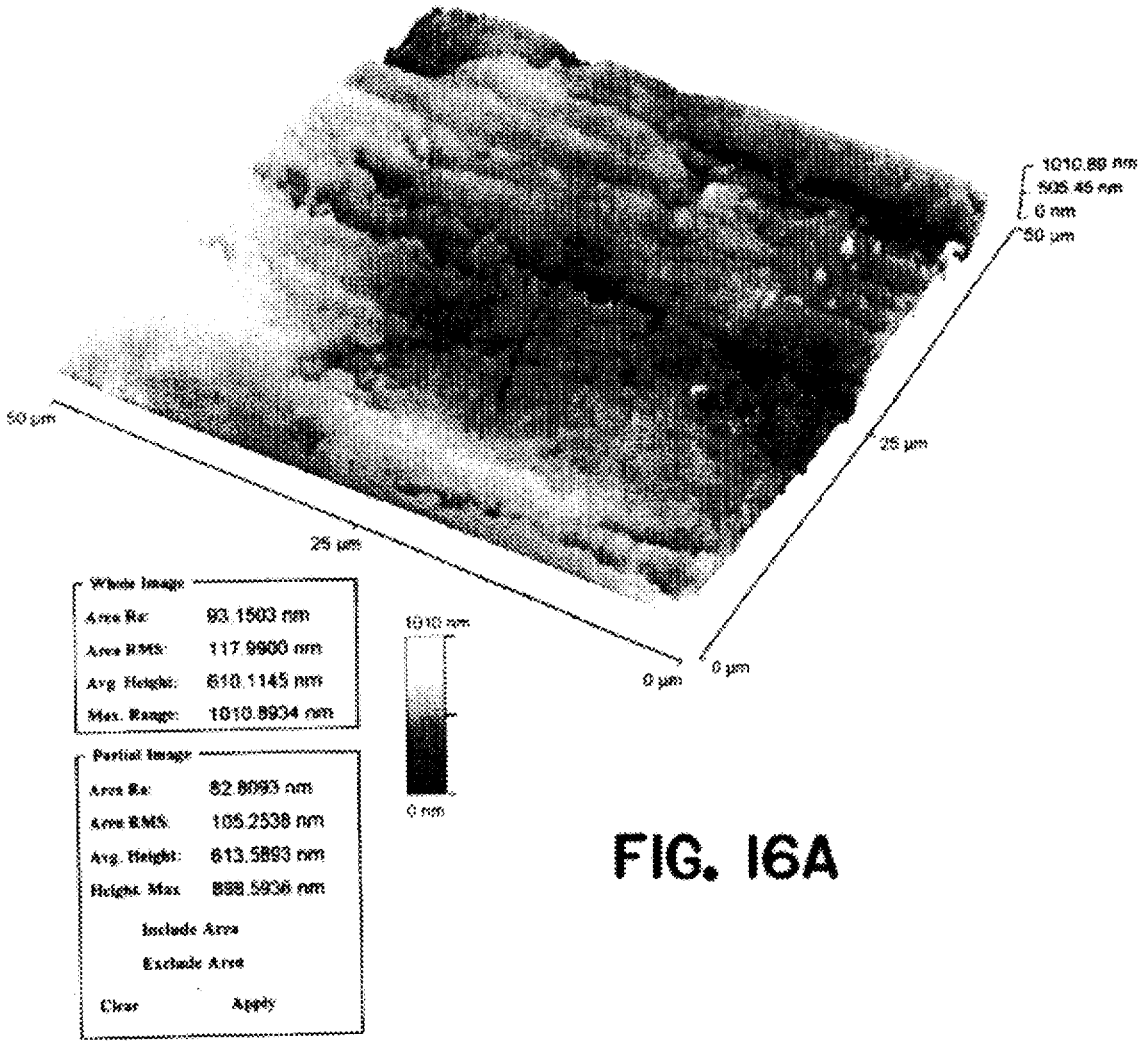
Figure 16B:
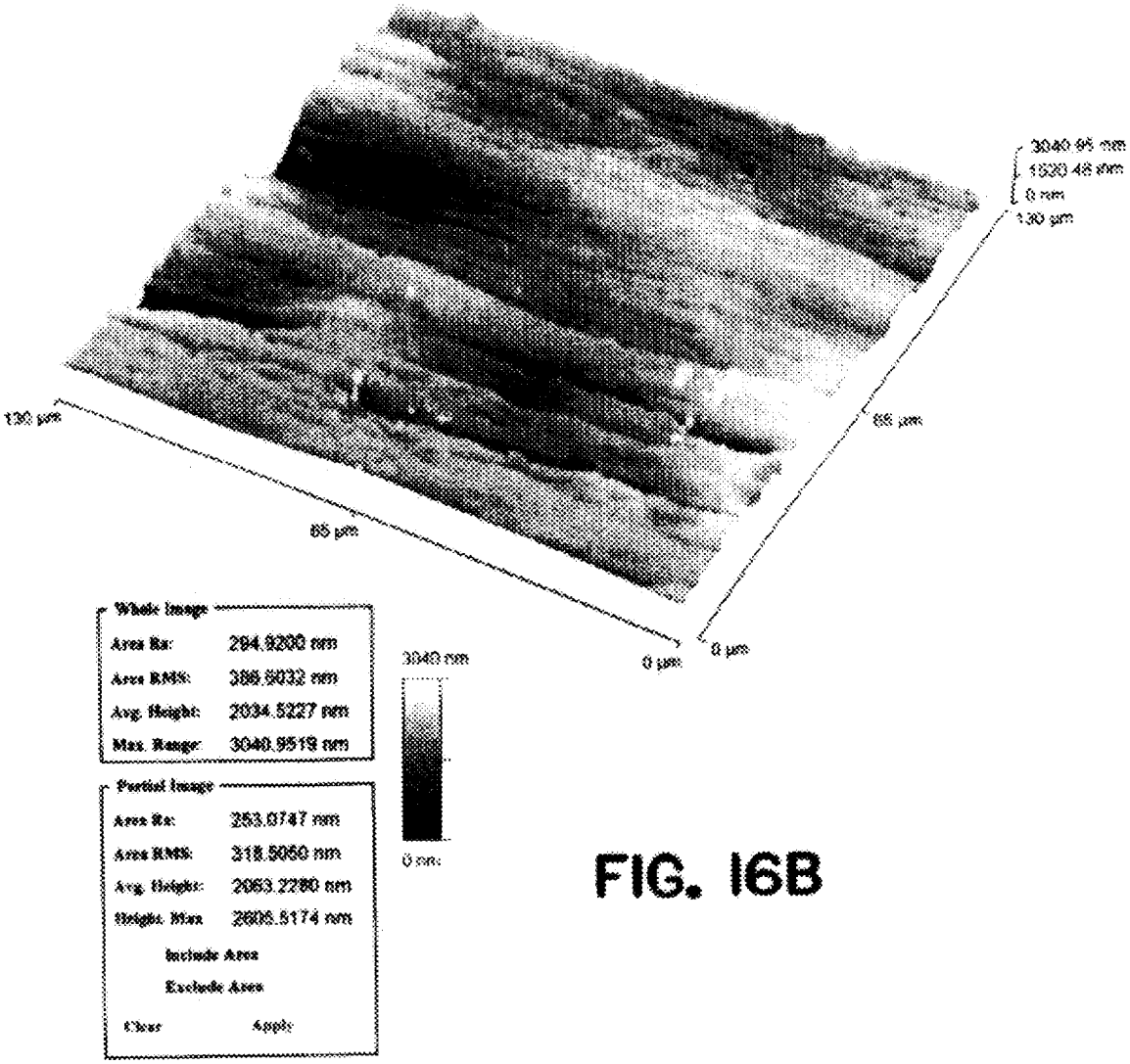
Figure 17:
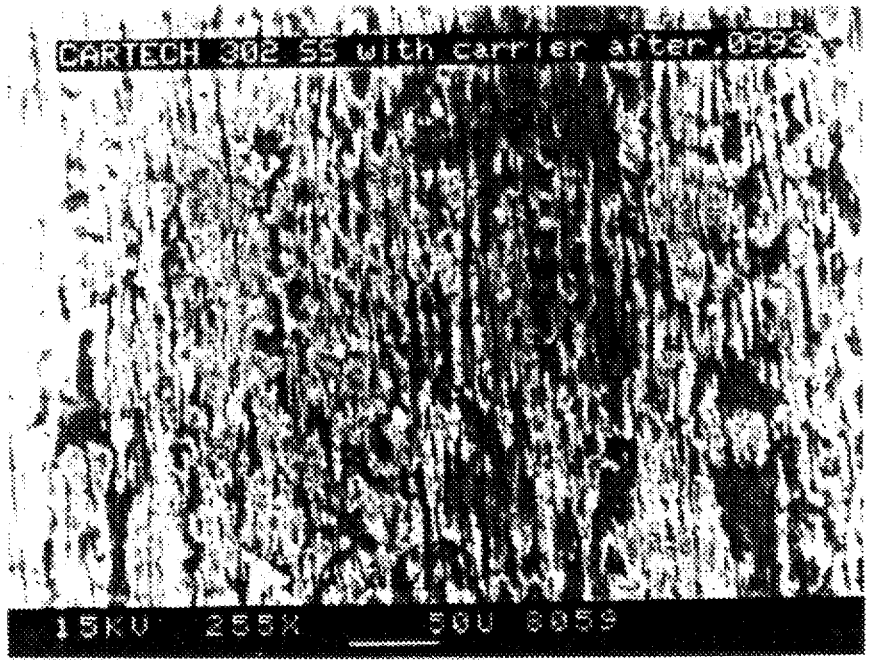
Figure 18A:
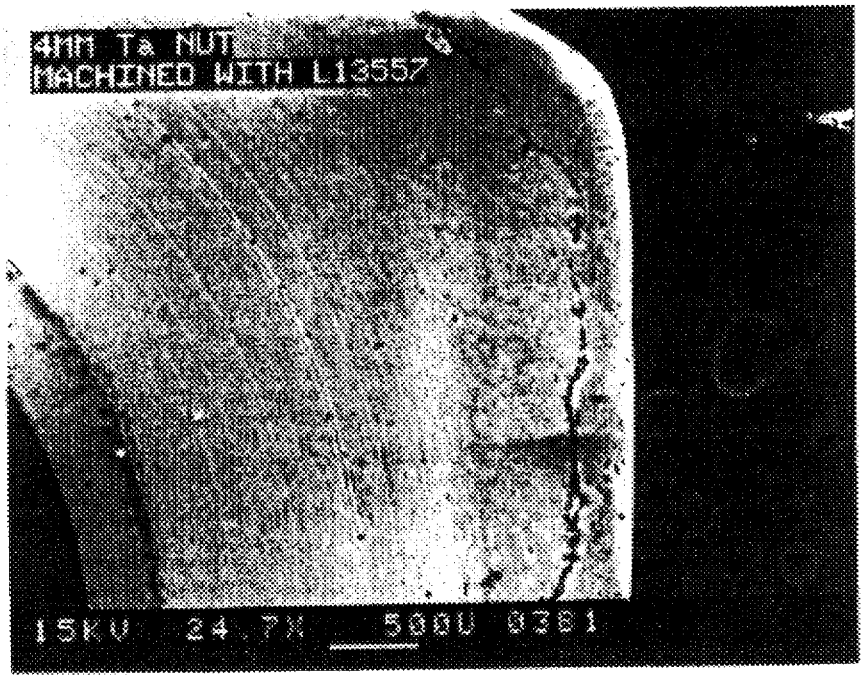
Figure 18B:
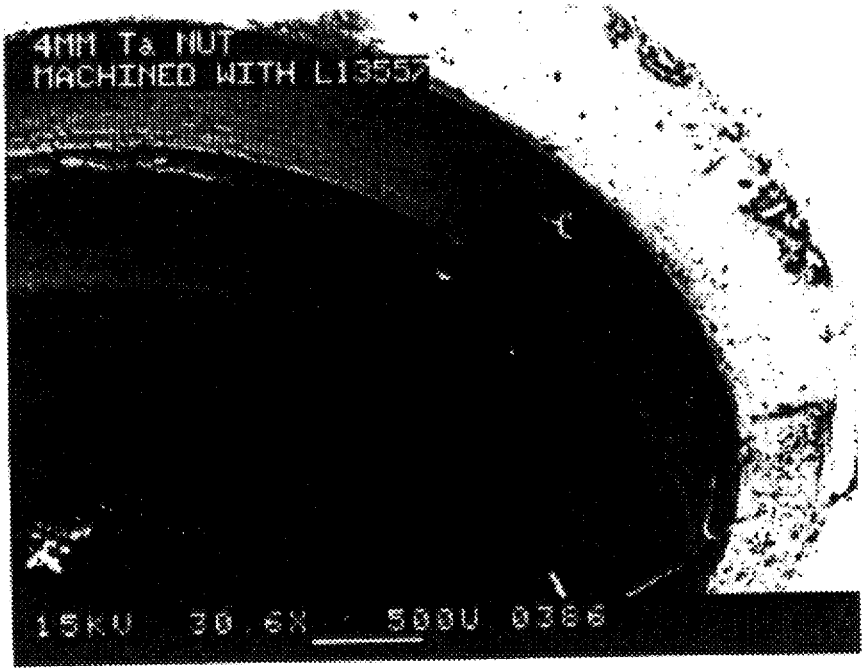
Figure 18C:
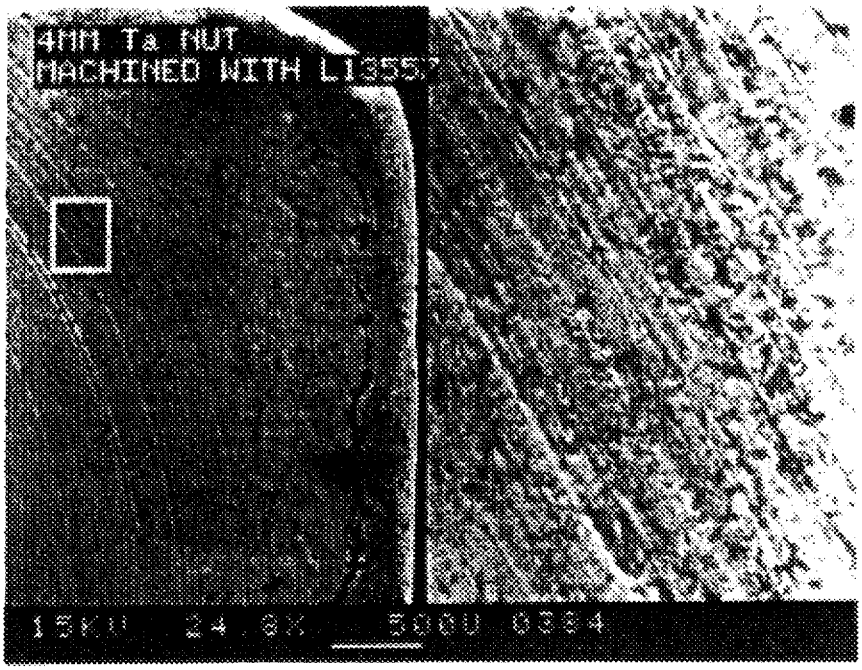

In order to further verify this finding experimentally, samples of both 0.0079" (0.0201 cm) and 0.0098" (0.0249 cm) diameter wire were submitted for as-received leakage tests. The DC leakage is measured by anodizing a length of wire to completely cover the surface with a tantalum oxide dielectric film. This anodized wire is placed in an electrolyte and a DC voltage is applied to the tantalum lead itself. The DC current "leaking" through the dielectric film is measured at a fixed voltage. This leakage current is a measure of the integrity of the dielectric film. The dielectric film integrity itself is a measure of the overall surface roughness and cleanliness of the wire surface. By producing a smooth surface free from residual lubricants, improved dielectric files are produced; thus improving DC leakage characteristics of the wire. These data are shown in FIG. 12 and indicate that the as-received leakage values for as-drawn wire fall in the range of 1 to 3 μamps/cm$^3$. They certainly compare favorably with recent production and compare very favorably with the specification maximum of 10 μamps/cm$^3$ commonly seen in the industry. In actual production trials employing the 3M Company's FC-40 perfluorocarbon fluid, the most significant advantages observed include a greater than five-fold increase in die life, a greater than ten-fold increase in wire-drawing speed, "electronically clean" as-drawn wire, and a five-fold reduction in lubricant cost. In addition, a major reduction in the amount of submicron tantalum fine particle debris has been observed. While using the CTFE lubricants, the filters on the wire-drawing machines are changed at the end of every production shift. When using PFC fluids, these filters are changed every one to two months. It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. Process for high speed fine wire-drawing of tantalum metal comprising the steps of (a) introducing a large diameter, elongate tantalum workpiece into a conventional wet wire-drawing machine having at least one reduction die;

(b) lubricating the elongate workpiece during the drawing process with a fluid selected from the group consisting of perfluoroalkanes having the general formula $C_nF_{2n+2}$ and perfluoroamines and a viscosity less than 20 centistokes;

(c) drawing the elongate workpiece through said at least one die lubricated with a perfluorocarbon fluid by a method selected from the group consisting of total immersion, splashing, spraying, and dripping, the conditions of drawing being conducted in relation to the related perfluorocarbon fluid to conduct the drawing at enhanced speed and higher reduction per pass; and (d) repeating the process until the necessary wire diameter is obtained, and further characterized in that surface cleaning for lubricant removal is essentially avoided in all of the above steps, the method producing a lubricant-free final wire.

2. Process in accordance with claim 1 wherein the wire drawn has an average diameter between 5 mils (0.127 mm) and 20 mils (508 mm).

3. Process for high speed fine wire-drawing comprising the steps of (a) introducing a large diameter elongate workpiece into a conventional wet wire-drawing machine having at least one reduction die;

(b) lubricating the elongate workpiece during the drawing process with a fluid selected from the group consisting of perfluoroalkanes having the general formula $C_nF_{2n+2}$ and perfluoroamines;

(c) drawing the elongate workpiece through said at least one die lubricated with a perfluorocarbon fluid by a method selected from the group consisting of total immersion, splashing, spraying, and dripping, the conditions of drawing being conducted in relation to the related perfluorocarbon fluid to conduct the drawing at enhanced speed and higher reduction per pass; and (d) repeating the process until the necessary wire diameter is obtained and further characterized in that surface cleaning for lubricant removal is essentially avoided in all of the above steps, the method producing a lubricant-free final wire.

4. Process in accordance with claim 3 wherein, the material to be drawn is selected from the group consisting of refractory and reactive metals.

5. Process in accordance with claim 4 wherein the refractory metal is tantalum.

* * * * *